United States Patent [19]

Cooper

[11] Patent Number: 4,681,310

[45] Date of Patent: Jul. 21, 1987

[54] SORTING APPARATUS

[75] Inventor: Thomas F. Cooper, Rochester, N.Y.

[73] Assignee: Xerox Corporation, Stamford, Conn.

[21] Appl. No.: 779,010

[22] Filed: Sep. 23, 1985

[51] Int. Cl.[4] ..... B42C 1/12

[52] U.S. Cl. ..... 270/53; 271/293; 271/294

[58] Field of Search ..... 271/293, 294; 270/53, 270/58

[56] References Cited

U.S. PATENT DOCUMENTS

| | | | |
|---|---|---|---|
| 3,788,640 | 1/1974 | Stemmle . | |
| 3,848,868 | 1/1974 | Stemmle . | |
| 3,866,904 | 2/1975 | Stemmle . | |
| 4,055,339 | 10/1977 | Looney | 271/294 |
| 4,361,393 | 11/1982 | Noto | 270/53 |
| 4,466,609 | 8/1984 | Lawrence | 271/293 |
| 4,478,406 | 10/1984 | Dubois . | |

FOREIGN PATENT DOCUMENTS

| | | | |
|---|---|---|---|
| 220053 | 12/1983 | Japan | 271/293 |

*Primary Examiner*—Richard A. Schacher

*Attorney, Agent, or Firm*—H. Fleischer; J. E. Beck; R. Zibelli

[57] ABSTRACT

An apparatus in which sheets are sorted in selected ones of a plurality of movable trays shiftable relative to one another. One edge of the trays is supported with the remaining edges thereof being unsupported. Successive trays move from one side of a sheet inlet region to the other side thereof with the trays shifting relative to one another to provide wide entry regions at the sheet inlet region and at a sheet securing region.

12 Claims, 4 Drawing Figures

SORTING APPARATUS

This invention relates generally to a sorting apparatus coupled to an electrophotographic printing machine, and more particularly concerns a sorting apparatus having provisions for on-line stapling or binding.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing a developer mixture into contact therewith. Generally, the developer mixture comrises toner particles adhering triboelectrically to carrier granules. The toner particles are attracted from the carrier granules to the latent image forming a toner powder image on the photoconductive member. The toner powder image is then transferred from the photoconductive member to a copy sheet. Finally, the copy sheet is heated to permanently affix the toner particles thereto in image configuration.

Frequently, it is highly desirable to reproduce a plurality of copies of the same original document. Moreover, if several original documents are reproduced, it is desirable to form a plurality of collated sets of copies. This may be achieved by the utilization of a sorting apparatus. Generally, the sorting apparatus comprises a plurality of bins or trays wherein each tray is designed to collect one set of copies of the original document. A variety of sorters are known in the art. One typical sorter employs tray members which are spaced apart and extend in a linear row. Another type of sorting apparatus has tray member extending radially outwardly from an axis of rotation. These are the two basic types of sorters generally used commercially, i.e. a linear type and a rotary type.

Copy sheets may be collected in the trays of the sorter in a number of ways. The most common technique is to utilize a sheet transport to advance the copy sheets past the tray openings and deflection fingers to guide the sheets from the transport into the respective tray. Another technique comprises the use of a moving deflection finger which travel from tray to tray to deflect the copy sheet into the respective tray. Yet still another approach is to move the trays past the sheet ejecting portion of the transport. In this way, the trays collect successive sheets therein.

Hereinbefore, a finishing station rather than a sorting apparatus has been employed wherein it is desirable to secure the copy sheets of the set to one another. Generally, the finishing station collects a set of copy sheets reproduced in an electrophotographic printing machine employing a recirculating document handling system. This set of original documents is then forwarded to the finishing station wherein the copies of the set are jogged to align them with one another and subsequently stapled or bound together. Alternatively, the sets of collated copies may be removed from a sorting apparatus and advanced to a stapling or binding apparatus for securing the copy sheet to one another in collated sets. However, it would be highly desirable to be capable of securing the sets of collated copies to one another in the respective trays or bins of the sorting apparatus.

Various types of sorters have previously been employed, the following disclosures appear to be relevant:

U.S. Pat. No. 3,788,640; Patentee: Stemmle; Issued: Jan. 29, 1974.

U.S. Pat. No. 3,848,868; Patentee: Stemmle; Issued: Nov. 19, 1974.

U.S. Pat. No. 3,866,904; Patentee: Stemmle; Issued: Feb. 18, 1975.

U.S. Pat. No. 4,466,609; Patentee: Lawrence; Issued: Aug. 21, 1984.

U.S. Pat. No. 4,478,406; Patentee: DuBois; Issued: Oct. 23, 1984.

Co-Pending Application Ser. No. 637,235; Applicant: Barone; Filed: Aug. 2, 1984.

The relevant portions of the foregoing disclosures may be briefly summarized as follows:

Stemmle (U.S. Pat. No. 3,788,640) and Stemmle (U.S. Pat. No. 3,866,904) disclose a sorter having trays supporting movably on three cams. Each cam has a variable spiral groove to move the trays vertically so that the trays are in close proximity to each other except when positioned adjacent to the sheet discharge zone where adjacent trays are spaced widely apart from one another. Groups of trays are also spaced apart a lesser distance to facilitate unloading of the sheets therefrom.

Stemmle (U.S. Pat. No. 3,848,868) describes a sorter having trays mounted pivotably therein. A cam having a spiral shaped groove rotates to move a head assembly vertically. The head assembly includes a tapered conical member having a spiral groove formed therein. As the head assembly moves vertically, the spiral groove in the conical member receives successive cam followers extending from the free end of each tray. The conical member rotates as the head assembly moves vertically causing the trays to pivot open to receive the sheet being deflected therein.

Lawrence discloses a sorter having trays supported at their inner ends within a frame structure with their outer ends extending freely from the frame structure. A spring biases the trays toward one another and toward a helical cam. The trunnions of successive trays are positioned in the spiral cam track to widely space adjacent trays from one another at a sheet entry location.

DuBois describes a sorter having trays with trunnions extending therefrom. Drive cams move vertically and rotate about their axis. The drive cams have a spiral groove for receiving the trunnions of the trays. When the drive cams rotate, the trunnions follow the spiral groove moving the trays upwardly or downwardly to separate the trays immediately above and below the cams. The sheet is then received in the tray.

Barone discloses a sorter in which the trays have one side edge supported with the other side edge, sheet outlet end, and sheet inlet end being unsupported. A rotating cam moves successive trays from one side of the sheet inlet region to the other side thereof, and shifts the trays relative to one another to provide a wide entry region between adjacent trays at the sheet inlet region.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents that may be included within the spirit and scope of the invention as defined by the appended claims.

Figure 1:
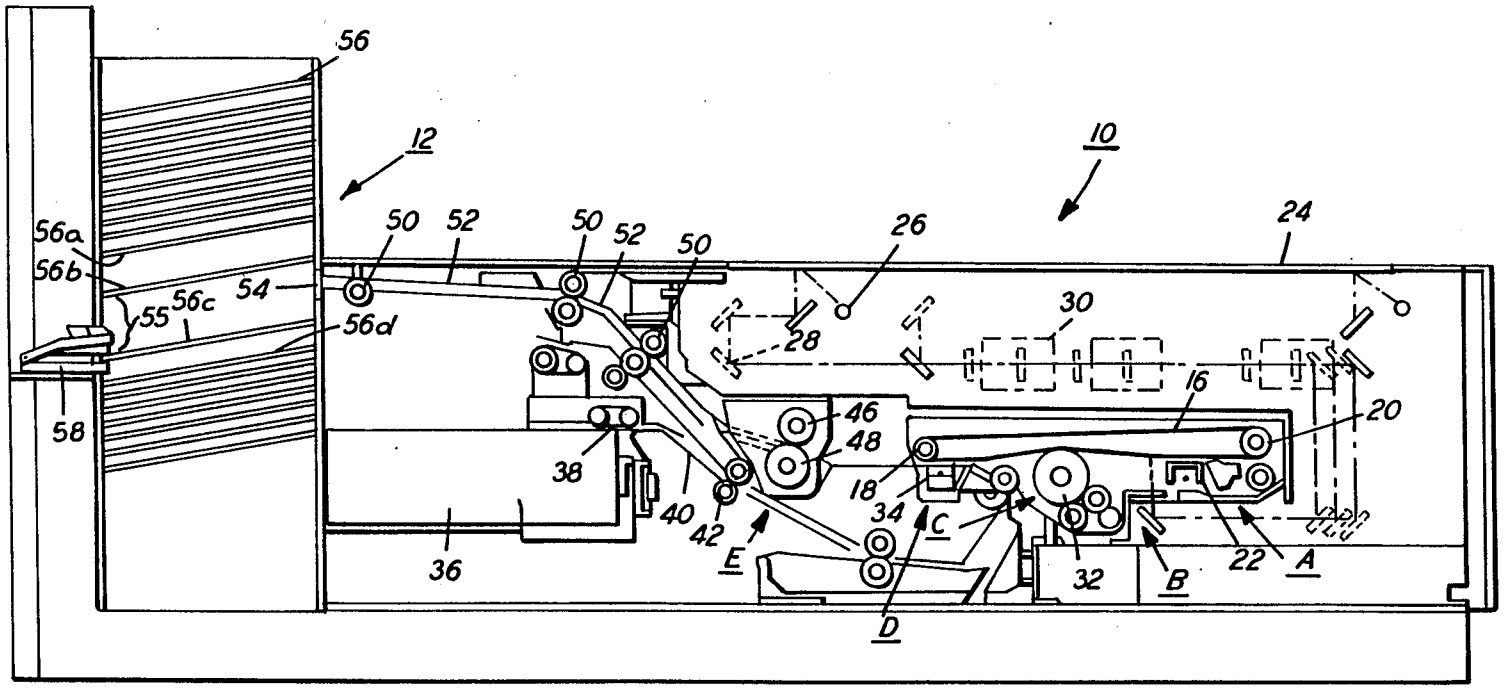
FIG. 1 is a schematic elevational view depicting an electrophotographic printing machine incorporating the features of the sorting apparatus therein.

For a general understanding of the features of the present invention, reference is made to the drawings. In the drawings, like reference numerals have been used throughout to designate identical elements. FIG. 1 schematically depicts the various components of the illustrative electrophotographic printing machine having the sorting apparatus of the present invention coupled thereto. It will become evident from the following discussion that the sorting apparatus of the present invention is equally well suited for use in a wide variety of printing systems, and it is not necessarily limited in its application to the particular machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine 10 is coupled to a sorting apparatus 12. Printing machine 10 employs a belt 16 having a photoconductive surface deposited on a conductive substrate. Preferably, the photoconductive surface is made from a selenium alloy with the conductive substrate being made from an aluminum alloy. Other suitable photoconductive materials and conductive substrates may also be employed. Belt 16 is entrained about a pair of opposed, spaced rollers 18 and 20. Roller 20 is rotated by a motor coupled thereto by suitable means, such as a drive belt. As roller 20 rotates, belt 16 advances the photoconductive surface through the various processing stations disposed about the path of movement thereof.

Initially, the photoconductive surface passes through charging station A. At charging station A, a corona generating device 22 charges the photoconductive surface to a relatively high, substantially uniform potential.

Next, the charged portion of the photoconductive surface is advanced through imaging station B. At imaging station B, an original document is positioned face down upon a transparent platen 24. Imaging of a document on platen 24 is achieved by an exposure system which includes a lamp 26, mirrors 28 and a moving lens 30. The exposure system is a moving optical system wherein the lamps, mirrors and lens move across the original document illuminating incremental widths thereof. In this way, an incremental width light image is formed. The light image is projected onto the charged portion of the photoconductive surface. The charge on the photoconductive surface is dissipated selectively by the light image to record an electrostatic latent image of the original document thereon. Thereafter, belt 10 advances the electrostatic latent image recorded on the photoconductive surface to development station C.

With continued reference to FIG. 1, at development station C, a magnetic brush developer roller 32 advances developer material into contact with the electrostatic latent image. The latent image attracts toner particles from the carrier granules of the developer material to form a toner powder image on the photoconductive surface of belt 16.

Belt 16 then advances the toner powder image to transfer station D. Successive copy sheets are advanced from stack 36 by sheet feeder 38. Sheet feeder 38 advances the uppermost sheet from stack 36 into chute 40. Forwarding rollers 42 and 44 continue to advance the sheet to transfer station station D. At transfer station D, a corona generator 34 sprays ions onto the backside of the copy sheet positioned thereat. This transfers the toner powder image on the photoconductive surface of belt 16 to the sheet. After transfer of the toner powder image to the copy sheet, the copy sheet advances through fusing station E.

Fusing station E includes a heated fuser roller 46 and a back-up roller 48 with the toner powder image on the sheet contacting fuser roller 46. In this manner, the powder image is permanently affixed to the copy sheet.

After fusing, the copy sheets are advanced by forwarding rollers 50 through chute 52 to the copy sheet outlet region. Sorter 12 is located adjacent the copy sheet outlet region to receive the copy sheet at sorter inlet region 54. The group of trays 56 above sorter inlet region 54 are closely spaced to one another. At the sorter inlet region 54, trays **56*a* and 56*b* are spaced apart a distance preferably of about 2 inches. Tray 56*c* is spaced from tray 56*b* to define a sheet securing region. After the requisite number of copies have been sorted on trays 56 of sorter 12, the trays move past securing region 55 where the sheets are stapled to one another by stapler 58. Preferably, the distance between adjacent trays in securing region 55 is about 3 inches. Thus, tray 56*c* is spaced a distance of about 3 inches from tray 56*b*. Tray 56*d* is also spaced a distance from tray 56*c* to permit the lower portion of stapler 58 to be interposed between trays 56*c* and 56*d*. Thus, stapler 58 is periodically moved into its stapling position wherein a portion thereof extends into the securing region defined between trays 56*b* and 56*c* with a portion thereof being positioned between trays 56*c* and 56*d*. Preferably, the space between trays 56*c* and 56*d* is about 1 inch. Movement of stapler 58 is controlled by the printing machine controller which is coupled to the sorting apparatus. Thus, the printing machine controller sends an end of job signal to a drive system for actuation thereof. The drive system is coupled to stapler 58 and moves stapler 58 from a remote position to an operative position wherein a portion thereof extends into the sheet securing region with a portion thereof located between trays 56*c* and 56*d*. In this latter position, stapler 58 secures the sets of sheets to one another as the trays pass through securing region 55. The end of job signal, generated by the printing machine, indicates that all of the copies have been completed and that the copies are now located in the respective sorter trays. Thus, each sorter tray contains a complete set of copies which correspond to the set of original documents. The sets of copies in each tray are now stapled to one another as the trays pass through securing region 55. It is clear that sorter trays 56 are mounted movably and shiftably relative to one another. One edge of the trays are supported by sorter frame 58. The other ends of trays 56** are unsupported by any structure other than the tray itself. Thus, the trays are cantilevered with one end of the trays being supported with the sheet inlet, sheet outlet and other end of the trays being unsupported.

Figure 2:
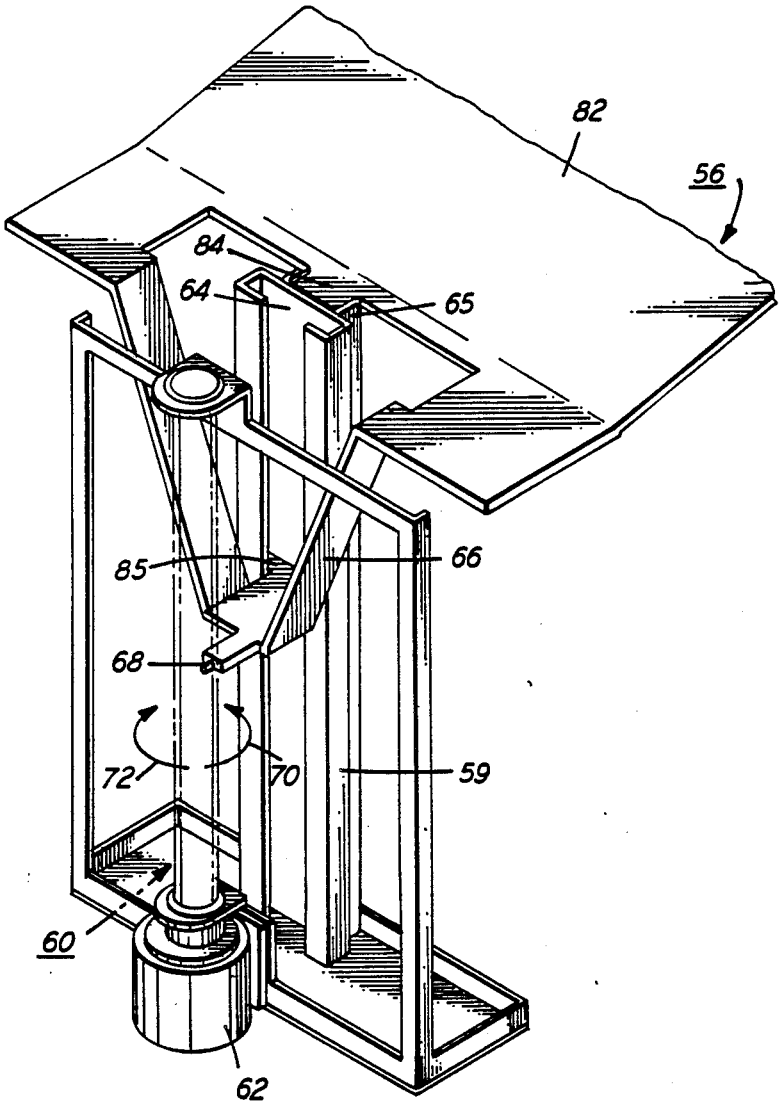
FIG. 2 is a fragmentary perspective view depicting the sorting apparatus used in the FIG. 1 printing machine.

Turning now to FIG. 2, there is shown a perspective view illustrating an exemplary tray being driven by the drive system of the sorting apparatus. As shown in FIG. 2, a lead screw 60 is mounted in frame 58 and connected to motor 62. Frame 59 has a groove 64 for receiving tab 85 of tray 56 therein. A V-shaped yoke 66 extends downwardly from tray 56 and has a follower 68 extending horizontally therefrom. Follower 68 is adapted to mesh with the threads of lead screw 60. Tray 56 is inclined and slopes downwardly toward lead screw 60. Frame 59 has a groove 65 on the side opposed to groove 64 for receiving tab 84 therein. Tray 56 has a generally planar surface which is inclined downwardly toward lead screw 60 so as to facilitate the holding of sheets thereof. Motor 62 is a bi-directional motor and rotates in the direction of arrows 70 or 72 depending upon the desired direction of movement of tray 56, i.e. upwardly or downwardly. Lead screw 60 has a low pitch spiral camming surface 74 (FIG. 3) for positioning the trays closely adjacent to one another, i.e. nesting the trays. An intermediate pitch spiral camming surface 76 (FIG. 3) is provided to space adjacent trays apart from one another in the sheet entry region. A high pitch spiral camming surface 78 (FIG. 3) is proivded to space adjacent trays apart in the sheet securing region. This enables a portion of stapler 58 to be positioned between adjacent rays for securing the sets of sheets of the trays passing therethrough to one another. A medium pitch camming service 80 (FIG. 3) is provided to space adjacent trays apart from one another a distance sufficient to enable a portion to stapler 58 to be located therebetween during the stapling operation. Low pitch spiral camming surfaces 74 are located on opposed sides of intermediate pitch spiral camming surface 76 and medium pitch spiral camming surface 80. High pitch spiral camming surface 78 is immediately adjacent intermediate spiral camming surface 76. Medium pitch spiral camming surface 80 is located immediately adjacent thigh pitch spiral camming surface 78 as well. Thus, high pitch spiral camming surface 78 is interposed between intermediate pitch spiral camming surface 76 and medium pitch spiral camming surface 80.

Figure 3:
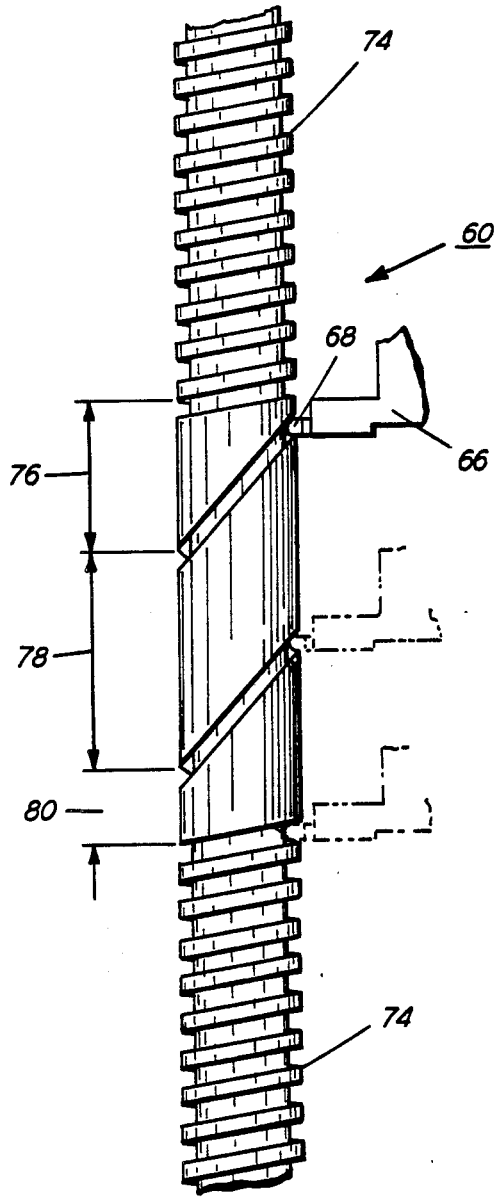
FIG. 3 is a fragmentary, elevational view showing the lead screw adapted to move the trays of the FIG. 2 sorting apparatus.

Referring now to FIG. 3, there is shown the detailed structure of lead screw 60. As shown therein, low pitch spiral camming surface 74 has a 1½ inch pitch. Medium pitch spiral camming surface 80 has a 1 inch pitch. Intermediate pitch spiral camming surface 76 has a 2 inch pitch. High pitch spiral camming surface 78 has a 3 inch pitch. Follower 68 rides on the camming surfaces of lead screw 60 to move trays 56 accordingly. A shown, follower 68 is mounted on yoke 66 which supports tray 56. In the region of the low pitch camming surfaces, the trays are nested or closely adjacent to one another. In the region of the intermediate pitch spiral camming surface 76, adjacent trays are spaced from one another defining a wide entry region for permitting sheets from the printing machine to pass onto trays 56. High pitch spiral camming surface 78 defines the sheet securing region. In this region, after all of the sheets have been sorted on their respective trays, the collated sets are stapled to one another. Medium pitch spiral camming surface 80 defines a space between adjacent trays to enable a portion of the stapler to be positioned thereat. Stapler 58 is positioned remotely from the sheet securing region defined by high pitch spiral camming surface 78. After the sorting operation is completed, and the securing operation initiated, stapler 58 is moved to its operative position wherein a portion thereof extends into the region defined by high pitch spiral camming surface 78 and medium pitch spiral camming surface 80. At this time, stapler 58 is energized to staple the sets of sheets on the trays passing through the sheet securing region defined by high pitch spiral camming surface 78.

While a stapling apparatus has been described as securing the sheets to one another in the sheet securing region, one skilled in the art will appreciate that other devices may be employed. For example, a binding apparatus may be used to adhesively secure the sheets to one another in the sheet securing apparatus.

Figure 4:
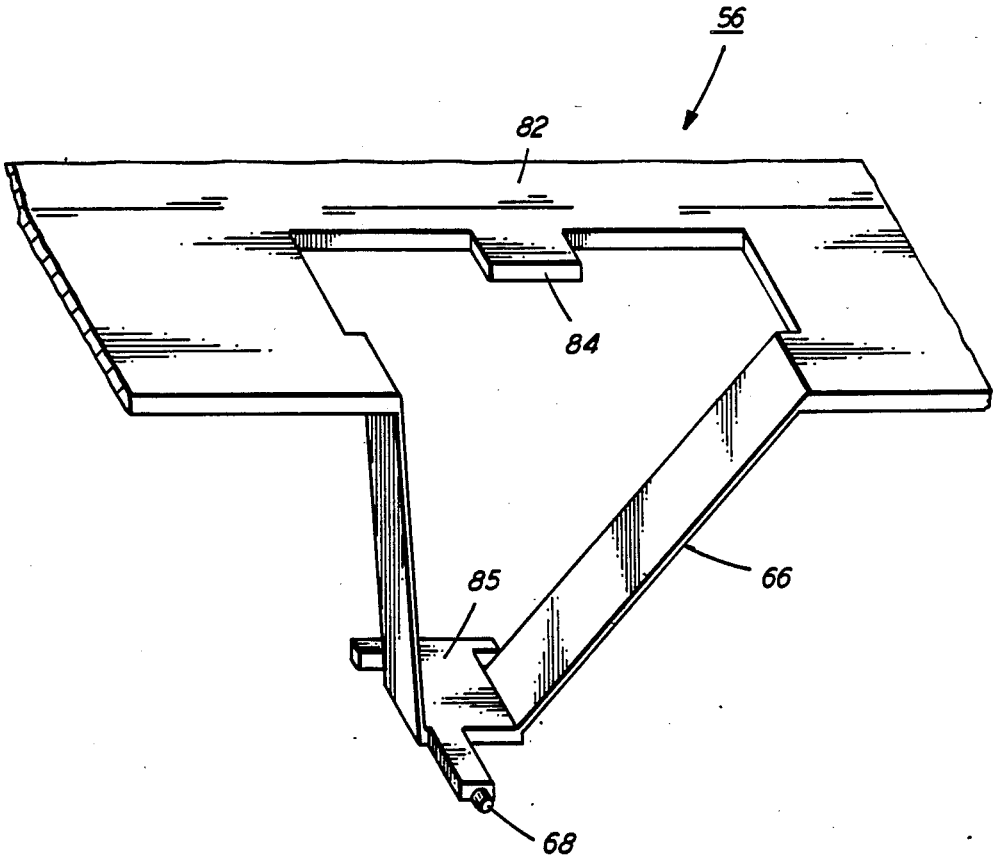
FIG. 4 is a fragmentary perspective view depicting one of the trays of the FIG. 2 sorting apparatus.

Turning now to FIG. 4, there is shown a tray 56 in greater detail. As shown therein, tray 66 has a generally planar surface 82 for receiving the copy sheets thereon. A tab 84 extends from planar surface 82 and is adapted to be interfit into groove 65 (FIG. 2) in frame 59 (FIG. 2). V-shaped yoke 66 provides the support for the general planar portion 82 of tray 56. Region 86 is open to facilitate stacking of the sheets. The V-shaped yoke 66 of adjacent trays are adapted to nest within one another. Follower 68 extends from the lowermost portion of V-shaped yoke 66 and is adapted to mesh with the camming surfaces of lead screw 60. Tab 85 also extends from the lowermost portion of yoke 66 and is adapted to be interfit into groove 64 (FIG. 2) in frame 59.

Pursuant to the features of the present invention, there is provided an apparatus for sorting sheets. The apparatus includes a plurality of movable trays shiftable relative to one another. Means support one edge of the plurality of trays with the remaining edges being unsupported. Means are provided for moving successive trays from one side of a sheet inlet region to the other side thereof with said plurality of trays shifting relative to one another to provide a first wide entry region between adjacent trays of the sheet inlet regions and a second wide entry region on one side of the sheet inlet region at a sheet securing In accordance with another aspect of the present invention, there is provided a printing system including means for reproducing copies of original documents on copy sheets. Means, positioed to receive the copy sheets from the reproducing means at a sheet inlet region, sort the copy sheets into sets of documents. The sorting means comprises a plurality of movable trays that shift relative to one another. Means support one edge of the plurality of trays with the remaining edges thereof being unsupported. Means move successive trays from one side of the sheet inlet region to the other side thereof with the plurality of trays shifting relative to one another to provide a first wide entry region between adjacent trays at the sheet inlet region and a second wide entry region on one side of the sheet inlet region at a sheet securing region.

Other aspects of the present invention will become apparent as the following description proceeds and upon reference to the drawings, in which:

FIG. 1 is a schematic elevational view depicting an electrophotographic printing machine incorporating the features of the sorting apparatus therein;

FIG. 2 is a fragmentary perspective view depicting the sorting apparatus used in the FIG. 1 printing machine;

FIG. 3 is a fragmentary, elevational view showing the lead screw adapted to move the trays of the FIG. 2 sorting apparatus; and FIG. 4 is a fragmentary perspective view depicting one of the trays of the FIG. 2 sorting apparatus.

While the present invention will hereinafter be described in connection with a preferred embodiment thereof, it will be understood that it is not intended to limit the invention to the embodiment. On the contrary, it is intended to cover all alternatives, modifications, and equivalents that may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of the illustrative electrophotographic printing machine having the sorting apparatus of the present invention coupled thereto. It will become evident from the following discussion that the sorting apparatus of the present invention is equally well suited for use in a wide variety of printing systems, and it is not necessarily limited in its application to the particular machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine 10 is coupled to a sorting apparatus 12. Printing machine 10 employs a belt 16 having a photoconductive surface deposited on a conductive substrate. Preferably, the photoconductive surface is made from a selenium alloy with the conductive substrate being made from an aluminum alloy. Other suitable photoconductive materials and conductive substrates may also be employed. Belt 16 is entrained about a pair of opposed, spaced rollers 18 and 20. Roller 20 is rotated by a motor coupled thereto by suitable means, such as a drive belt. As roller 20 rotates, belt 16 advances the photoconductive surface through the various processing stations disposed about the path of movement thereof.

Initially, the photoconductive surface passes through charging station A. At charging station A, a corona generating device 22 charges the photoconductive surface to a relatively high, substantially uniform potential.

Next, the charged portion of the photoconductive surface is advanced through imaging station B. At imaging station B, an original document is positioned face down upon a transparent platen 24. Imaging of a document on platen 24 is achieved by an exposure system which includes a lamp 26, mirrors 28 and a moving lens 30. The exposure system is a moving optical system wherein the lamps, mirrors and lens move across the original document illuminating incremental widths thereof. In this way, an incremental width light image is formed. The light image is projected onto the charged portion of the photoconductive surface. The charge on the photoconductive surface is dissipated selectively by the light image to record an electrostatic latent image of the original document thereon. Thereafter, belt 10 advances the electrostatic latent image recorded on the photoconductive surface to development station C.

With continued reference to FIG. 1, at development station C, a magnetic brush developer roller 32 advances developer material into contact with the electrostatic latent image. The latent image attracts toner particles from the carrier granules of the developer material to form a toner powder image on the photoconductive surface of belt 16.

Belt 16 then advances the toner powder image to transfer station D. Successive copy sheets are advanced from stack 36 by sheet feeder 38. Sheet feeder 38 advances the uppermost sheet from stack 36 into chute 40. Forwarding rollers 42 and 44 continue to advance the sheet to transfer station station D. At transfer station D, a corona generator 34 sprays ions onto the backside of the copy sheet positioned thereat. This positions toner powder image on the photoconductive surface of belt 16 adjacent to the sheet. After transfer of toner powder image to the copy sheet, the copy sheet advances through fusing station E.

Fusing station E includes a heated fuser roller 46 and a back-up roller 48 with the toner powder image on the sheet contacting fuser roller 46. In this manner, the powder image is permanently affixed to the copy sheet.

After fusing, the copy sheets are advanced by forwarding rollers 50 through chute 52 to the copy sheet outlet region. Sorter 12 is located adjacent the copy sheet outlet region to receive the copy sheet at sorter inlet region 54. The group of trays 56 above sorter inlet region 54 are closely spaced to one another. At the sorter inlet region 54, trays **56*a* and 56*b* are spaced apart a distance preferably of about 2 inches. Tray 56*c* is spaced from tray 56*b* to define a sheet securing region. After the requisite number of copies have been sorted on trays 56 of sorter 12, the trays move part securing region 55 where the sheets are stapled to one another by stapler 58. Preferably, securing region 55 is about 3 inches. Thus, tray 56*c* is spaced a distance of about 3 inches from tray 56*b*. Tray 56*d* is also spaced a distance from tray 56*c* to permit the lower portion of stapler 58 to be interposed between trays 56*c* and 56*d*. Thus, stapler 58 is periodically moved into its stapling position wherein a portion thereof extends into the securing region defined between trays 56*b* and 56*c* with a portion thereof being positioned between trays 56*c* and 56*d*. Preferably, the space between trays 56*c* and 56*d* is about 1 inch. Movement of stapler 58 is controlled by the printing machine controller which is coupled to the sorting apparatus. Thus, the printing machine controller sends an end of job signal to a drive system for actuation thereof. The drive system is coupled to stapler 58 and moves stapler 58 from a remote position to an operative position wherein a portion thereof extends into the sheet securing region with a portion thereof located between trays 56*c* and 56*d*. In this latter position, stapler 58 secures the sets of sheets to one another as the trays pass through securing region 55. The end of job signal, generated by the printing machine, indicates that all of the copies have been completed and that the copies are now located in the respective sorter trays. Thus, each sorter tray contains a complete set of copies which correspond to the set of original documents. The sets of copies in each tray are now stapled to one another as the trays pass through securing region 55. It is clear that sorter trays 56 are mounted movably and shiftably relative to one another. One edge of the trays are supported by sorter frame 58. The other ends of trays 56** are unsupported. Thus, the trays are cantilevered with one end of the trays being supported with the sheet inlet, sheet outlet and other end of the trays being unsupported.

In recapitulation, it is evident that the sorting apparatus of the present invention includes a plurality of trays supported on one edge thereof with the other edges being unsupported. The trays are movable and shiftable relative to one another. In this way, successive trays move from one side of the sheet inlet region to the other side thereof with the trays shifting relative to one another to provide a wide entry region between adjacent trays at a sheet inlet region and a sheet securing region. It is, therefore, evident that there has been provided in accordance with the present invention, a sorting apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications, and variations as fall within the spirit and broad scope of the appended claims.

I claim:

1. An apparatus for sorting sheets, including:

a plurality of movable trays shiftable relative to one another;

means for supporting one edge of said plurality of trays with the remaining edges thereof extending freely from said supporting means;

means for moving successive trays from one side of a sheet inlet region to the other side thereof with said plurality of trays shifting relative to one another to provide a first wide entry region between adjacent trays at the sheet inlet region and a second wide entry region having one side thereof adjacent one side of the first wide entry region at a sheet securing region; and means, positioned at the second wide entry region, for periodically attaching substantially permanently the sheets in the trays located thereat to one another.

2. An apparatus according to claim 1, wherein said moving means shifts said plurality of trays to provide a third wide entry region having one side thereof adjacent the other side of said second wide entry region.

3. An apparatus according to claim 2, wherein said moving means positions a plurality of trays on the other side of said first wide entry region closely adjacent to one another and a second plurality of trays on other side of said third wide entry region closely adjacent to one another.

4. An apparatus according to claim 3, wherein said attaching means includes a stapler mounted on said supporting means and adapted to be positioned at least partially in the second wide entry region and third wide entry region to periodically staple the sheets on the trays passing through the second wide entry region.

5. An apparatus according to claim 4, wherein said moving means includes:

a vertically extending cam member mounted in said supporting means for supporting said plurality of movable trays; and drive means for rotating said cam member to move vertically said plurality of movable trays.

6. An apparatus according to claim 5, wherein said cam member includes a low pitch spiral camming surface, a medium pitch spiral camming surface, an intermediate pitch spiral camming surface, and a high pitch spiral camming surface, said intermediate pitch spiral camming surface effecting a spreading movement between trays to form the first wide entry region, said high pitch spiral camming surface effecting a spreading movement between trays to form the second wide entry region, said medium pitch spiral camming surface effecting a spreading movement of the trays to form the third wide entry region, and said low pitch spiral camming surface positioning the trays on opposed sides of said first wide entry region and said third wide entry region closely adjacent to one another.

7. A printing system, including:

means for reproducing copies of original documents on copy sheets; and means, positioned to receive the copy sheets from said reproducing means at a sheet inlet region, for sorting the copy sheets from said sets of documents, said sorting means comprising a plurality of movable trays shiftable relative to one another, means for supporting one edge of said plurality of trays with the remaining edges thereof extending freely from said supporting means and means for moving successive trays from one side of the sheet inlet region to the other side thereof with said plurality of trays shifting relative to one another to provide a first wide entry region between adjacent trays at the sheet inlet region and a second wide entry region having one side thereof adjacent one side of the first wide entry region at a sheet securing region, and means, positioned at the sheet securing region, for attaching substantially permanently the sets of sheets in the trays located thereat to one another.

8. A printing system according to claim 7, wherein said moving means of said sorting means shifts said plurality of trays to provide a third wide entry region having one side thereof adjacent the other side of said second wide entry region.

9. A printing system according to claim 8, wherein said moving means of said sorting means positions a first plurality of trays on the other side of said first wide entry region closely adjacent to one another and a second plurality of trays on the other side of said third wide entry region closely adjacent to one another.

10. A printing system according to claim 9, wherein said attaching means of said sorting means includes a stapler mounted on said supporting means and adapted to be positioned at least partially in the second wide entry region and third wide entry region to periodically staple the sets of sheets on the trays passing through the second wide entry region.

11. A printing system according to claim 10, wherein said moving means of said sorting means includes:

a vertically extending cam member mounted in said supporting means for supporting said plurality of movable trays; and drive means for rotating said cam member to move vertically said plurality of movable trays.

12. A printing system according to claim 11, wherein said cam member of said moving means includes a low pitch spiral camming surface, a medium pitch spiral camming surface, an intermediate pitch spiral camming surface, and a high pitch spiral camming surface, said intermediate pitch spiral camming surface effecting a spreading movement between trays to form the first wide entry region, said high pitch spiral camming surface effecting a spreading movement between trays to form the second wide entry region, said medium pitch spiral camming surface effecting a spreading movement of the trays to form the third wide entry region, and said low pitch spiral camming surface positioning the trays on opposed sides of said first wide entry region and said third wide entry region closely adjacent to one another.

* * * * *